US009754742B2

(12) United States Patent
Terada et al.

(10) Patent No.: US 9,754,742 B2
(45) Date of Patent: Sep. 5, 2017

(54) GAS CIRCUIT BREAKER

(71) Applicant: Hitachi, Ltd., Chiyoda-ku, Tokyo (JP)

(72) Inventors: Masanao Terada, Tokyo (JP); Katsuhiko Shiraishi, Tokyo (JP); Yoichi Oshita, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/242,944

(22) Filed: Aug. 22, 2016

(65) Prior Publication Data

US 2017/0062157 A1 Mar. 2, 2017

(30) Foreign Application Priority Data

Aug. 31, 2015 (JP) ..... 2015-169982

(51) Int. Cl.
*H01H 33/42* (2006.01)
*H01H 33/91* (2006.01)

(52) U.S. Cl.
CPC ..... *H01H 33/42* (2013.01); *H01H 33/91* (2013.01); *H01H 2221/088* (2013.01)

(58) Field of Classification Search
CPC .... H01H 33/664; H01H 1/0203; H01H 1/025; H01H 1/04; H01H 1/42; H01H 2057/006; H01H 2235/01; H01H 2300/03; H01H 25/065; H01H 33/28; H01H 33/42; H01H 33/662; H01H 33/765; H01H 3/3021
See application file for complete search history.

(56) References Cited

U.S. PATENT DOCUMENTS 4,080,521 A * 3/1978 Goedecke ..... H01H 33/7053 218/83
4,117,289 A * 9/1978 Taylor ..... H01H 33/56 218/77
4,408,108 A * 10/1983 Takatsuka ..... H01H 33/91 218/65
4,450,329 A * 5/1984 Arimoto ..... H01H 33/7023 218/57
5,258,590 A * 11/1993 Dufournet ..... H01H 33/91 218/63
5,939,692 A * 8/1999 Perret ..... H01H 33/905 218/43
5,977,502 A * 11/1999 Mizoguchi ..... H01H 33/901 218/43

(Continued)

FOREIGN PATENT DOCUMENTS

JP 2004-119315 A 4/2004

*Primary Examiner* — Truc Nguyen
(74) *Attorney, Agent, or Firm* — Crowell & Moring LLP

(57) ABSTRACT

A gas circuit breaker includes a driving side electrode having a driving side main contact and a driving side arc contact, and a driven side electrode having a driven side main contact and a driven side arc contact in a sealed tank. The driving side electrode is connected to an operation device. The driven side electrode is coupled to a bidirectional driving mechanism unit. A sliding guide, on which the driven side main contact slides, is provided on an inner periphery side of the driven side main contact. The driven side main contact is energized by a coil spring in a direction of the sliding guide and has two contact surfaces. Only during normal conduction, one of the contact surfaces contacts a projected portion of the sliding guide and the other of the contact surfaces contacts the driving side main contact.

4 Claims, 5 Drawing Sheets

(56) References Cited

U.S. PATENT DOCUMENTS

| | | | | |
|---|---|---|---|---|
| 2009/0045170 | A1* | 2/2009 | Shimizu | H01H 33/90 218/62 |
| 2010/0224594 | A1* | 9/2010 | Uchii | H01H 33/7076 218/52 |
| 2013/0284703 | A1* | 10/2013 | Yoshitomo | H01H 33/91 218/84 |

* cited by examiner

GAS CIRCUIT BREAKER

BACKGROUND OF THE INVENTION

1. Field of the Invention

The present invention relates to a gas circuit breaker used for interrupting a short circuit current in a power system. In particular, the present invention relates to a gas circuit breaker having a bidirectional driving mechanism that drives electrodes in mutually opposite directions.

2. Description of the Related Art

A so-called puffer type gas circuit breaker is commonly used as a gas circuit breaker in a high-voltage power system. Using pressure rise of an arc extinguishing gas during interruption operation, the puffer type gas circuit breaker interrupts current by spraying the compressed gas to an arc generated between electrodes. The electrodes are constituted of a driving side electrode, which is driven by an operation device using oil pressure, spring, or the like, and a driven side electrode disposed opposite thereto. Each of the electrodes is constituted of a main contact that forms a main current path during a normal connection and an arc contact where the arc is generated when the current is interrupted.

To improve breaking performance of the puffer type gas circuit breaker, a bidirectional driving method has been proposed in which the driven side electrode, which has been fixed heretofore, is driven in a direction opposite to a driving direction of the driving side electrode.

A bidirectional driving mechanism disclosed in JP-2004-119315-A has an electrode support to which an opposing main contact and an opposing arc contact are fixed, and the electrode support is coupled to an insulation nozzle through a link mechanism, a connection rod, and a connection ring, whereby an opposing main contact portion and a movable contact portion operate in mutually conflicting directions.

The gas circuit breaker is provided with a plurality of finger contact point members, each of which having the opposing main contact and an opposing sliding contact point integrally formed therein. The opposing main contact is formed at a tip part of the finger contact point member, and the opposing sliding contact point is formed in the middle thereof. By using this configuration, there is provided the gas circuit breaker in which the number of parts, a size, and a cost are reduced and reliability is improved.

SUMMARY OF THE INVENTION

A problem existing in a gas circuit breaker of the bidirectional driving method in which a driven side main contact is operated is that a load acting on a bidirectional driving mechanism unit becomes large since the heavy main contact is operated at a high speed. A finger electrode according to JP-2004-119315-A allows a high contact pressure to act on an entire operation section, whereby a friction force thereof cannot be ignored, and the load on the mechanism unit becomes large.

In the above-described finger electrode, it is necessary to secure a certain degree of length in an opening and closing axis direction so as to have flexibility, whereby a volume, or a weight, of the electrode is increased, and the load on the mechanism unit and the operation device is increased. Due to an increase of such load, it is necessary to make the bidirectional driving mechanism unit large to ensure strength thereof. Since the load including a weight of the mechanism unit acts on the operation device, a width of reduction of operation energy becomes small.

To solve the problem, the gas circuit breaker according to an embodiment of the present invention includes a driving side electrode and a driven side electrode provided opposite to each other in a sealed tank (100). The driving side electrode has a driving side main contact (2) and a driving side arc contact (4). The driven side electrode has a driven side main contact (3) and a driven side arc contact (5). The driving side electrode is connected to an operation device (1), and the driven side electrode is coupled to a bidirectional driving mechanism unit (101). There is provided a sliding guide (18) on which the driven side main contact (3) slides on an inner periphery side of the driven side main contact (3). The driven side main contact (3) is energized in a direction of the sliding guide by a coil spring (19). The driven side main contact (3) has two contact surfaces (3A and 3B), and only during normal conduction, one of the contact surfaces (3B) contacts a projected portion (181) provided to the sliding guide (18) and the other of the contact surfaces (3A) contacts the driving side main contact (2).

According to an embodiment of the present invention, it is possible to decrease the friction force accompanying a contact pressure of the main contact and to decrease a weight of a main body of the main contact, whereby it is possible to reduce the operation energy compared to that of the conventional bidirectional driving method.

DESCRIPTION OF THE PREFERRED EMBODIMENTS

Hereinafter, a gas circuit breaker according to an embodiment of the present invention is described with reference to the drawings. Note that the following is only an example and is not intended to be limiting content of the invention to the following specific aspects. The invention may be carried out in various aspects in conformity with content described in claims.

In the example below, an exemplary circuit breaker having a mechanical compression chamber and a heat expansion chamber is described; however, it is also possible to apply the present invention to, for example, a circuit breaker having the mechanical compression chamber only. A bidirectional driving mechanism of a lever method is described as an example; however, it is also possible to apply the present invention to, for example, another bidirectional driving method such as a grooved cam method. Furthermore, a bidirectional driving method in which a driven side main contact and an arc contact are simultaneously driven is used as the example; however, it is also possible to use a method in which each of the contacts is separately driven.

First Example

Figure 2:
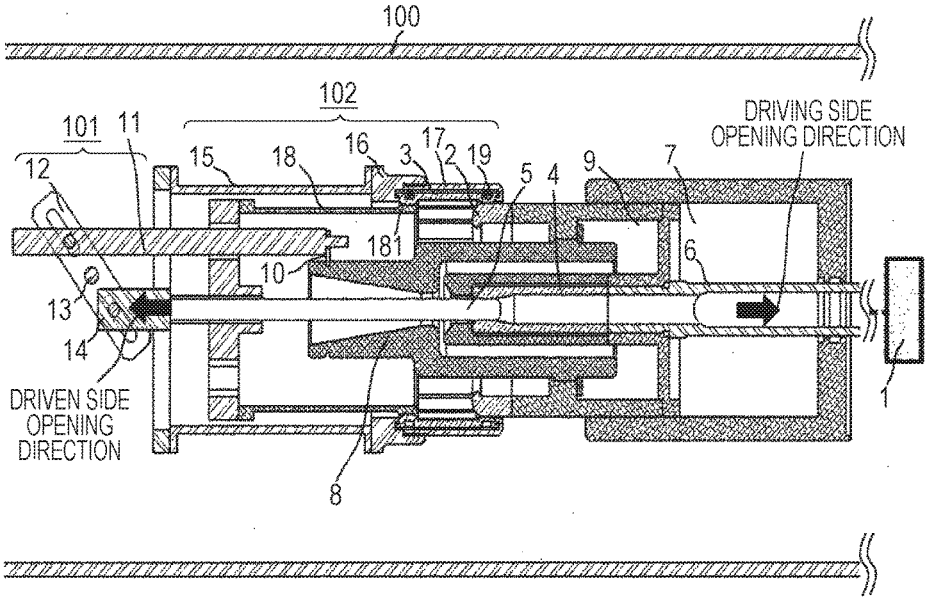
FIG. 2 is a sectional view illustrating a normal connection state of the gas circuit breaker according to the embodiment of the present invention.

In FIG. 2, a normal connection state of a gas circuit breaker according to an embodiment of the present invention is illustrated.

Figure 1:
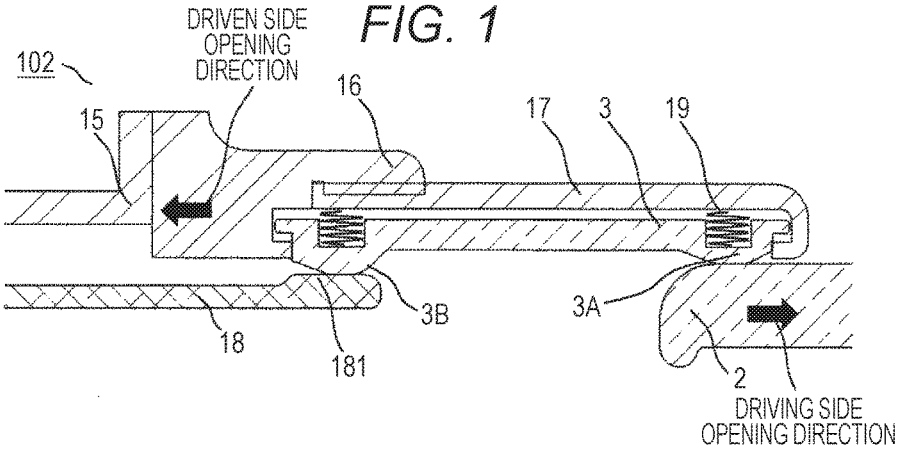
FIG. 1 is a sectional view illustrating main contacts of a gas circuit breaker according to an embodiment of the present invention.

In a sealed tank 100, a driving side electrode and a driven side electrode are coaxially provided opposite to each other. As illustrated in FIGS. 1 and 2, the driving side electrode has a driving side main contact 2 and a driving side arc contact 4, and the driven side electrode has a driven side main contact 3 and a driven side arc contact 5.

An operation device 1 is provided adjacent to the sealed tank 100. A shaft 6 is coupled to the operation device 1, and at a tip of the shaft 6, a driving side arc contact 4 is provided. The shaft 6 and the driving side arc contact 4 are provided so as to penetrate through a mechanical compression chamber 7 and a heat expansion chamber 9. On an interruption unit side of the heat expansion chamber 9, the driving side main contact 2 and a nozzle 8 are provided.

A tip portion of the nozzle 8 is fastened to a driving side coupling rod 11 with a coupling ring 10, and integrally with the driving side main contact 2, the driving side arc contact 4, and the shaft 6, it is coupled to one end of a lever 12 of a bidirectional driving mechanism unit 101. A driven side main contact unit 102 and the driven side arc contact 5 are fastened together with a driven side coupling member 14, are connected to the other end of the lever 12 of the bidirectional driving mechanism unit 101, and are driven in a direction opposite to a driving side by rotation of the lever 12 with a lever fix pin 13 as a rotation axis.

As illustrated in FIG. 2, in the normal connection state, by a driving source using oil pressure or a spring of the operation device 1, the gas circuit breaker is set to a position to allow conduction of the driving side main contact 2 and the driven side main contact 3, constituting a circuit of a power system during a normal time.

To interrupt a short circuit current caused by lightning and the like, the operation device 1 is driven in an opening direction, and the driving side main contact 2 and the driven side main contact 3 are separated through the shaft 6. At the time, the short circuit current is commutated between the driving side arc contact 4 and the driven side arc contact 5, and an arc is generated. By extinguishing the arc by mechanical spraying of an arc extinguishing gas by the mechanical compression chamber 7 and by spraying of the arc extinguishing gas by the heat expansion chamber 9 using an arc heat, a current is interrupted.

In this example, to decrease operation energy of the bidirectional driving method gas circuit breaker, there is presented an electrode sliding structure that reduces a load on the driven side main contact 3 during operation. Hereinafter, the electrode sliding structure according to this example is described based on FIGS. 1, 3, and 4.

Figure 3:
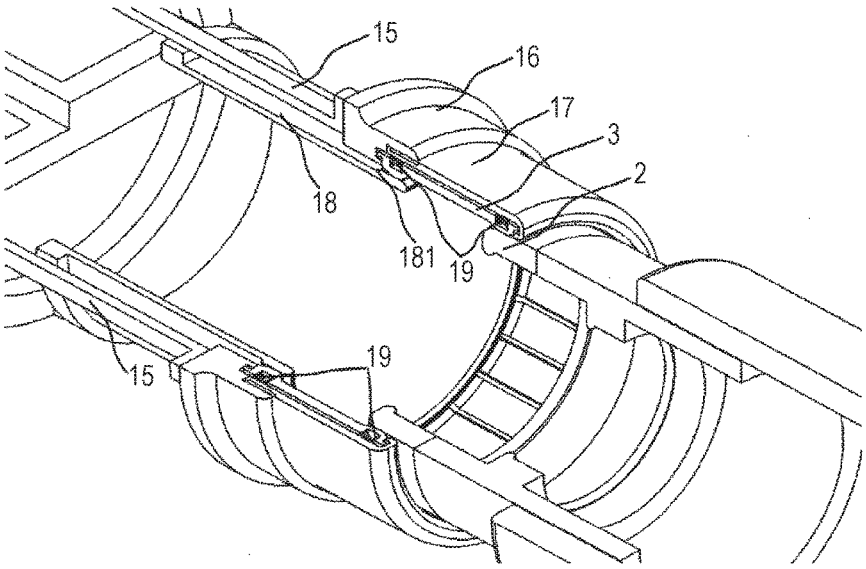
FIG. 3 is a partially cut-off perspective sectional view illustrating the main contacts of the gas circuit breaker according to the embodiment of the present invention.
Figure 4:
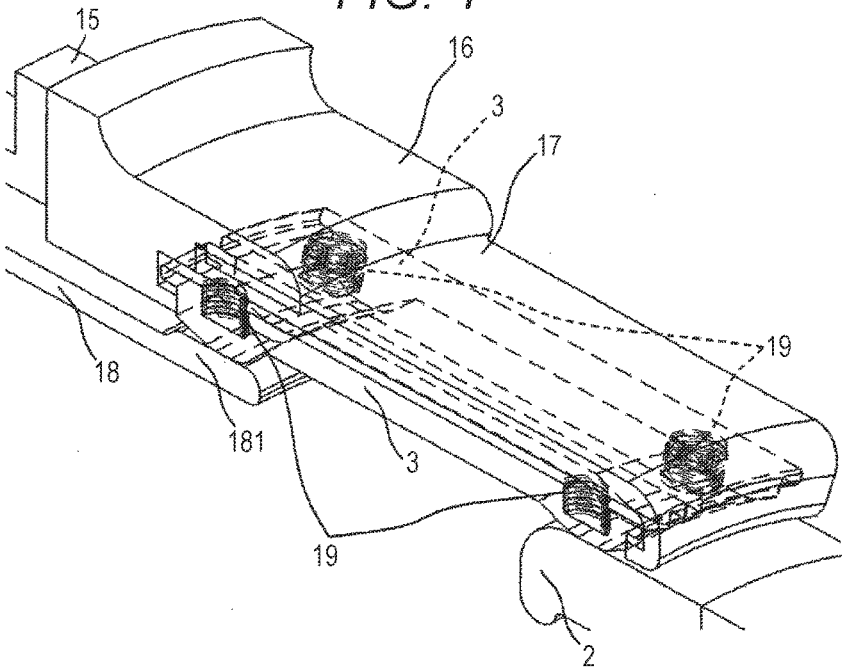
FIG. 4 is a perspective view illustrating the driven side main contact of the gas circuit breaker according to the embodiment of the present invention.

As illustrated in FIGS. 1, 3, and 4, the driven side main contact unit 102 is constituted of an integral electrode unit of the driven side main contact 3 and a compression coil spring 19 covered with a driven side main contact frame 17 and a driven side main contact presser 16, and a driven side main contact coupling rod 15 coupled thereto. The driven side main contact unit 102 is fastened to the driven side coupling member 14 of the bidirectional driving mechanism unit 101.

The driven side main contact 3 has a structure divided in a circumferential direction, and to secure contact pressure during normal conduction, the compression coil spring 19 is disposed to a recess provided on an outer periphery side. To hold a position of the compression coil spring 19, the driven side main contact frame 17 and the driven side main contact presser 16 are provided.

The driven side main contact 3 has a driving side contact surface 3A and a driven side contact surface 3B. Each of the contact surfaces has, for example, a projected shape, and during normal connection, contacts the driving side main contact 2 and a projected portion 181 provided to a tip of a driven side main contact sliding guide 18.

After the driving side main contact 2 and the driven side main contact 3 are separated during interruption of the current, the current is commutated between the driving side arc contact 4 and the driven side arc contact 5, whereby the contact pressure on a main contact side becomes unnecessary. Thus, after the interruption of the current (see FIG. 7), it is configured such that the contact pressure does not act between the driven side contact surface 3B of the driven side main contact 3 and the projected portion 181.

Hereinafter, each state during interruption operation is described by using FIGS. 5 to 9.

Figure 5:
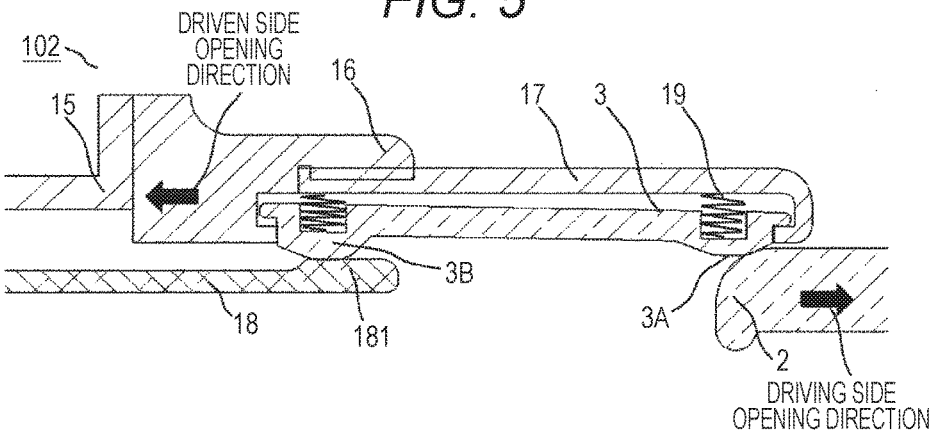
FIG. 5 is a sectional view illustrating the main contacts at a moment of separation of both of the main contacts of the gas circuit breaker according to the embodiment of the present invention.
Figure 6:
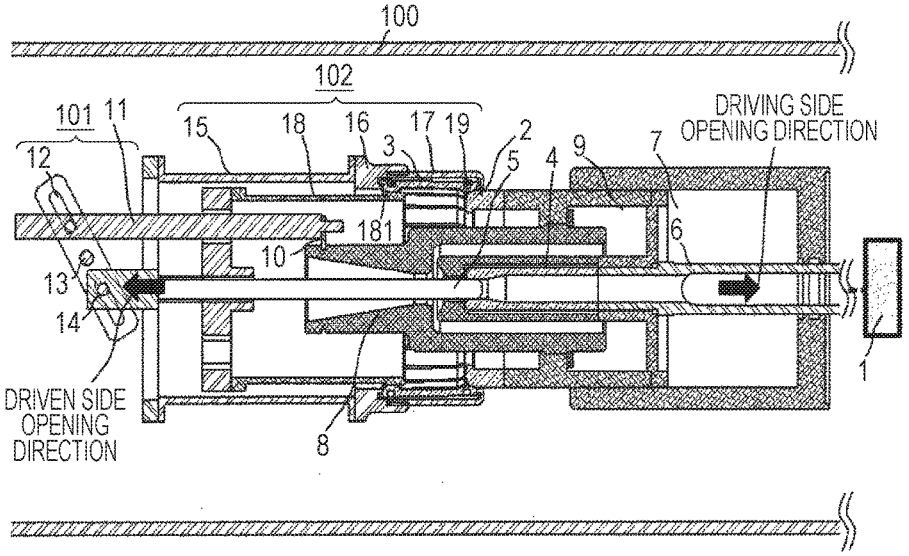
FIG. 6 is a sectional view illustrating a state of separation of both of the main contacts of the gas circuit breaker according to the embodiment of the present invention.

FIGS. 5 and 6 are views illustrating a state at a moment both of the main contacts are separated. In this state, the compression coil spring 19 on a driving side is released, the contact surface 3A moves to an inner periphery side, and the driven side main contact 3 tilts in a clockwise direction using 3B as a fulcrum. At this time, the position is held such that the driven side main contact 3 having a divided structure is not disassembled at the driven side main contact frame 17 and the driven side main contact presser 16.

Figure 7:
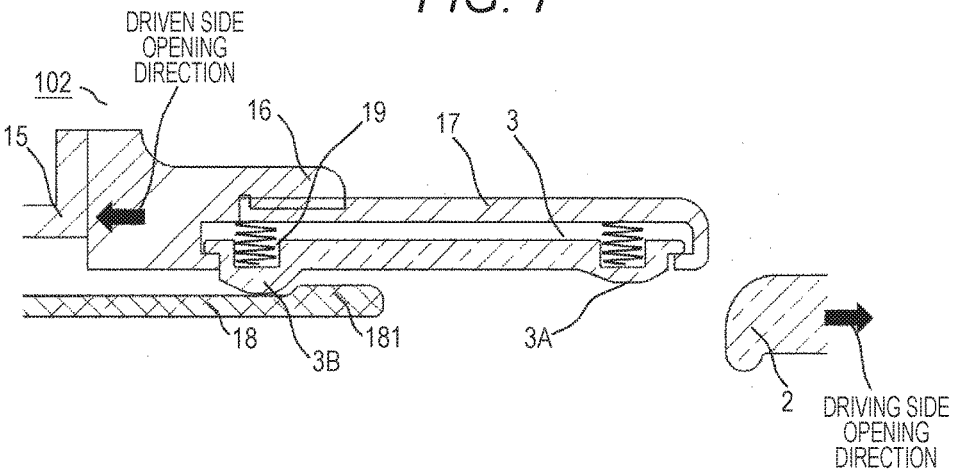
FIG. 7 is a sectional view illustrating a moment of removal of contact pressure from the driven side main contact of the gas circuit breaker according to the embodiment of the present invention.
Figure 8:
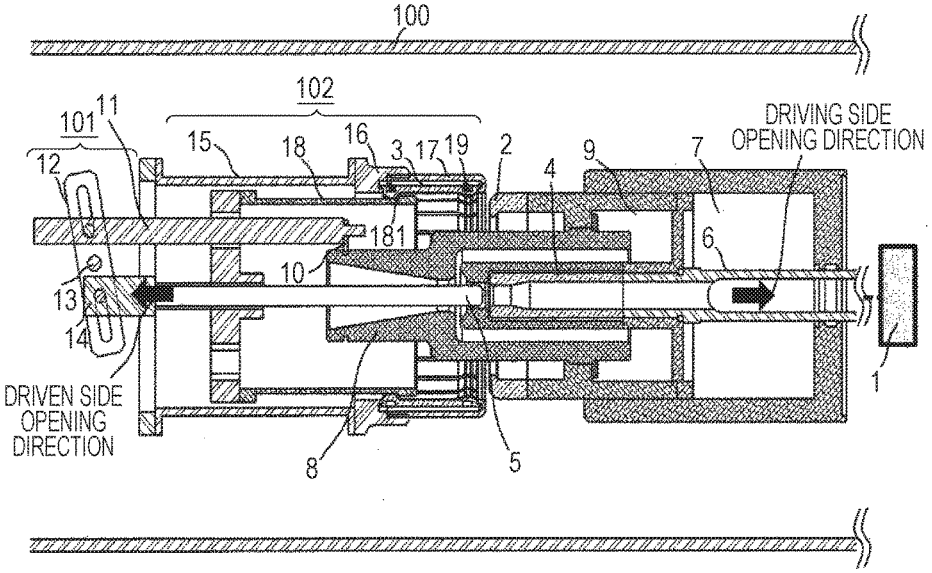
FIG. 8 is a sectional view illustrating a state of removal of the contact pressure from the driven side main contact of the gas circuit breaker according to the embodiment of the present invention.

FIGS. 7 and 8 are views illustrating a state immediately after removal of the contact pressure from the driven side main contact 3. In this state, by the driven side contact surface 3B going over the projected portion 181 of the driven side main contact sliding guide 18, the compression coil spring 19 on the driven side is released, the contact surface 3B moves to the inner periphery side, and the driven side main contact 3 moves to an inner diameter side compared to during the normal connection. At this time, the position is held such that the driven side main contact 3 having the divided structure is not disassembled at the driven side main contact frame 17 and the driven side main contact presser 16.

Figure 9:
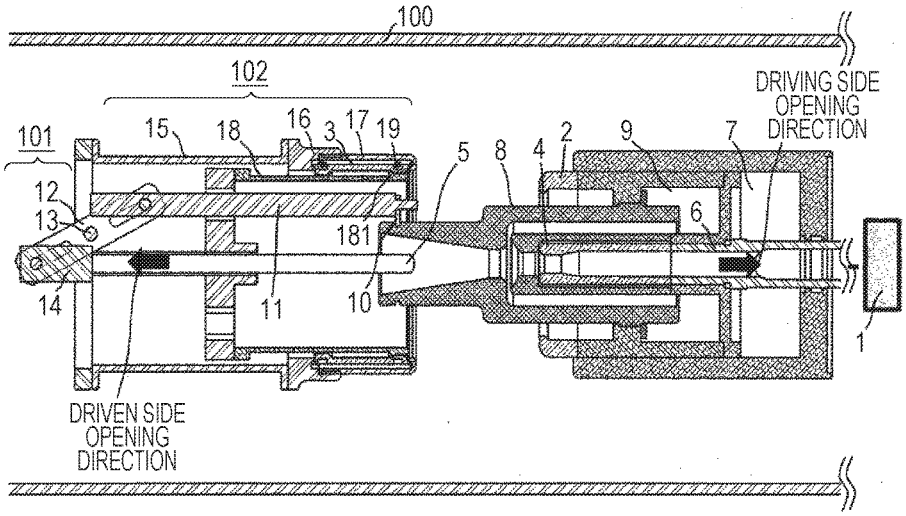
FIG. 9 is a sectional view illustrating an interruption state of the gas circuit breaker according to the embodiment of the present invention.

FIG. 9 is a view illustrating an interruption state. In an operation section from FIG. 8 to FIG. 9, a state in which the contact pressure does not act on the driven side main contact 3 continues. By making a diameter of the contact surface 3A larger than a diameter of a tip of the driven side main contact sliding guide 18, it is possible to operate without any interference between the contact surface 3A and the tip of the driven side main contact sliding guide 18.

As above, the projected portion 181 is provided to the driven side main contact sliding guide 18 such that the contact pressure is applied on the driven side main contact 3 only during the normal connection and such that the contact pressure does not act during the interruption operation. Accordingly, it is possible to decrease friction force during the operation.

The driven side main contact 3 is constituted of a combination of an electrode, which is divided in the circumferential direction and has the two contact surfaces 3A and 3B, and the compression coil spring 19 such that contact areas are the above-described projected portion 181 and the driving side main contact 2 only, and the divided electrode and the above-described compression coil spring 19 are held by the driven side main contact frame 17 and the driven side main contact presser 16. Accordingly, it is possible to achieve a compact electrode unit.

Furthermore, by coupling the driven side main contact presser 16 to the bidirectional driving mechanism unit 101 through a plurality of driven side main contact coupling rods 15, it is possible to decrease weight. By combining this together, it is possible to achieve a bidirectional driving gas circuit breaker in which the main contacts operate and with which it is possible to significantly reduce the load during the operation.

What is claimed is:

1. A gas circuit breaker including a driving side electrode and a driven side electrode provided opposite to each other in a sealed tank, the driving side electrode having a driving side main contact and a driving side arc contact, the driven side electrode having a driven side main contact and a driven side arc contact, the driving side electrode being connected to an operation device, the driven side electrode being coupled to a bidirectional driving mechanism unit, the gas circuit breaker comprising:

a sliding guide on which the driven side main contact slides being provided on an inner periphery side of the driven side main contact, wherein the driven side main contact is energized by a coil spring in a direction of the sliding guide, the driven side main contact has two contact surfaces, and only during normal conduction, one of the contact surfaces contacts a projected portion provided to the sliding guide and the other of the contact surfaces contacts the driving side main contact.

2. The gas circuit breaker according to claim 1, wherein the other of the contact surfaces has a diameter larger than a diameter of the projected portion.

3. The gas circuit breaker according to claim 1, wherein a plurality of the driven side main contacts is provided in a circumferential direction, and each of the driven side main contacts has the coil spring provided between the driven side main contacts and members covering the driven side main contacts.

4. The gas circuit breaker according to claim 3, wherein the members covering the driven side main contacts are coupled to the bidirectional driving mechanism unit through a plurality of coupling rods.

* * * * *